US005308422A

United States Patent [19]

Askay et al.

[11] Patent Number: 5,308,422

[45] Date of Patent: May 3, 1994

[54] METHOD OF MAKING CERAMIC/METAL COMPOSITES WITH LAYERS OF HIGH AND LOW METAL CONTENT

[75] Inventors: Ilhan A. Askay, Bellevue; David L. Milius, Seattle, both of Wash.; Mehrdad Yasrebi, Clackamas, Oreg.; Gyeung H. Kim; Mehmet Sarikaya, both of Seattle, Wash.

[73] Assignee: The Washington Technology Center, Seattle, Wash.

[21] Appl. No.: 743,605

[22] Filed: Aug. 12, 1991

[51] Int. Cl.[5] ..... B22D 19/00

[52] U.S. Cl. ..... 156/89; 164/100; 164/109; 264/44; 264/62

[58] Field of Search ..... 264/60, 62, 44, 43, 264/46.4, 42; 156/89; 164/98, 100, 109, 110

[56] References Cited

U.S. PATENT DOCUMENTS

| | | | |
|---|---|---|---|
| 3,975,165 | 8/1976 | Elbert et al. | 29/182.2 |
| 4,587,707 | 5/1986 | Nishida et al. | 29/527.7 |
| 4,604,249 | 8/1986 | Luhleich et al. | 264/29.5 |
| 4,605,440 | 8/1986 | Halverson et al. | 75/238 |
| 4,702,770 | 10/1987 | Pyzik et al. | 75/236 |
| 4,718,941 | 1/1988 | Halverson et al. | 75/236 |
| 4,777,153 | 10/1988 | Sonuparlak et al. | 501/82 |

OTHER PUBLICATIONS

Mechanical Property-Microstructural Relationships in Abalone Shell, Mehmet Sarikaya, Katie E. Gunnison, and Ilhan A. Aksay, J. Mater. Res., (Ref. 1), no date.

Biomimetic Processing of Ceramics and Ceramic-Metal Composites, M. Yasrebi, G. H. Kim, K. E. Gunnison, D. L. Milius, M. Sarikaya, and I. A. Aksay, Mat. Res. Soc. Symp. Proc., vol. 180, Dec. 1990.

Processing and Characterization of $B_4C$-Al Laminated Cermets, M. Yasrebi, G. H. Kim, D. L. Miluis, M. Sarikaya and I. A. Abray, Proceedings of the XIIth International Congress for Electron Microscopy, held Aug. 12, 1990.

DOE Technology to be Shared with Industry, Ron Dagani, Jul. 30, 1990, *Chemical Engr. News*, pp. 20, 21.

Ceramic-Metal Composites: Bulletproof Strength, Steven Ashley, Jul. 1990, *Mechanical Engineering*.

Fabrication and Mechanical Property of Laminated, $B_4C$-Al Composites, Abstract, M. Yasrebi, D. L. Milius and I. A. Aksay, Department of Materials, Science and Engineering, University of Washington, Seattle, Wash., Apr. 1990.

Chemical Processing of Ceramics, Donald R. Ulrich, Jan. 1, 1990, C&EN.

Fabrication and Mechanical Properties of Lamellar $Al_2O_3$ Ceramics, H. Takebe and K. Morinaga, *Journal of the Ceramic Society of Japan*, International Edition, vol. 96, pp. 1122-1128 (1988).

Dispersion in Nonaqueous Solvents for Enhanced Consolidation, Dennis Gallagher, Doctor of Philosophy, Dissertation University of Washington, 1988.

Processing of Boron Carbide-Aluminum Composites, D. C. Halverson, A. J. Pyzik, I. A. Aksay, and W. E. Snowden, *Adv. Ceram. Mat.*, (1987).

Microdesigning of Ceramic-Metal Composites, A. J. Pyzik, I. A. Aksay, and M. Sarikaya, *From: Ceramic Microstructures '86*, Edited by Pask and Evans (Plenum Publishing Corporation, 1988).

Processing and Microstructural Characterization of $B_4C$-Al Cermets. D. C. Halverson, A. J. Pyzik and I. A. Aksay, The Ceramic Engineering and Science Proceedings, vol. 6, Nos. 7-8, Jul. and Aug. 1985. Copyright 1985.

*Primary Examiner*—Jan H. Silbaugh
*Assistant Examiner*—Christopher A. Fiorilla
*Attorney, Agent, or Firm*—Christensen, O'Connor, Johnson & Kindness

[57] ABSTRACT

Composites of ceramic and metal exhibiting high fracture strength and toughness are formed from layers of the ceramic that have unequal concentrations and unequal porosity. The composites are made by a process that involves arranging layers of the ceramic in a predetermined pattern to provide a body that can be fully infiltrated by the metal.

24 Claims, 7 Drawing Sheets

METHOD OF MAKING CERAMIC/METAL COMPOSITES WITH LAYERS OF HIGH AND LOW METAL CONTENT

This invention was made with U.S. Government support under Grant No. AFOSR-87-0114 awarded by the Air Force Office of Scientific Research (AFOSR) and the Defense Advanced Research Projects Agency (DARPA) of the U.S. Department of Defense. The U.S. Government has certain rights in this invention.

FIELD OF THE INVENTION

The present invention relates to ceramic/metal composites and methods for making such composites.

BACKGROUND OF THE INVENTION

Ceramics, such as boron carbide, are a hard materials which are also lightweight, extremely stiff and more economical to use than diamonds and cubic boron nitrite, the only other materials known to be harder than boron carbide. Because of low weight and hardness, ceramics are particularly attractive for use as protective armor. However, due to their brittleness, ceramics are relatively easily fractured when stressed. To alleviate this problem, metals such as aluminum have been combined with ceramics to provide ceramic/metal composites that are generally stronger than steel by weight, somewhat less dense than the metal, and several times more resistant to fracture than the ceramic. Other proposed uses for such ceramic/metal composites include low inertia, dimensionally stable, and low vibration rotating components for computer hard disk drives; long-life bearings and races; premium performance sporting goods; high-efficiency, electron emission devices; cutting tools for hard to machine silicon aluminum alloys; and nuclear shielding.

Methods of making such ceramic/metal composite, also known as "cermets," are known. For instance, U.S. Pat. No. 4,605,440 and 4,702,770 disclose boron carbide and aluminum composites with tailorable microstructures. These patents describe forming the composites by infiltrating a monolith of boron carbide with aluminum.

More recently, U.S. Pat. No. 4,718,941 describes boron carbide-, boron-, boride-, and reactive metal composites that are made by infiltrating aluminum into a boron carbide sponge having gradient microstructures. The gradient boron carbide microstructures are described as being provided by controlled colloidal consolidation of boron carbide starting constituents or other techniques such as cold pressing, warm pressing, plasma jet coating, combustion synthesis, hot pressing, hot isostatic pressing, etc.

Despite the existence of these composites, there is still a need for ceramic/metal composites having improved fracture strength and toughness, and for fabrication methods which produce composites having such improved physical characteristics.

SUMMARY OF THE INVENTION

In one aspect, the present invention is a composite that includes a body of porous layers having unequal density of a ceramic material infiltrated with a metal. The porous body includes ceramic material that has been sintered or ceramic material that has not been sintered. In a preferred embodiment, the layers having different densities of ceramic material are arranged in an alternating pattern, e.g., alternating layers of high and low concentration. The preferred composites that include porous bodies of sintered ceramic material exhibit fracture strengths ranging from about 550 MPa to 1050 MPa and fracture toughness ranging from about 7 MPa-m$^{\frac{1}{2}}$ to 17 MPa-m$^{\frac{1}{2}}$. Such composites have densities ranging from about 2.45–2.65 grams per cubic centimeter. The composites exhibit a combination of fracture strength and toughness properties that make them suitable for many applications.

Another aspect of the present invention is a process for making such composites that includes the steps of forming a first and second set of layers from a precursor of the ceramic material. The first set of layers has a density of the precursor unequal to the density of the precursor in the second set of layers. A body of the precursor is formed from the layers, which is then sintered and subsequently infiltrated with the metal.

Ceramic/metal composites formed in accordance with the present invention that include a porous body of unsintered ceramic material are made by a process similar to the process used to make composites that include a porous body of sintered ceramic material. This process includes the steps of forming a first and second set of layers from a precursor of the ceramic material. The first set of layers has a density of the precursor unequal to the density of the precursor in the second set of layers. A body of the precursor is formed from the layers. The unsintered body of the precursor of the ceramic material can be infiltrated to provide a ceramic/metal composite without a sintering step.

Boron carbide/aluminum composites formed in accordance with the present invention have fracture strength and toughness properties heretofore not exhibited by known boron carbide/aluminum composites. The process described is economical and allows such properties to be tailored by controlling the relative densities of the ceramic in the composite.

Although the new process is particularly applicable to the fabrication of boron carbide/aluminum composites, the process can also be used with other ceramic starting constituents, and other reactive metals, or alloys, or compounds which reduce to the metal or alloy during the process.

DETAILED DESCRIPTION OF THE PREFERRED EMBODIMENT

In one aspect, the present invention relates to ceramic/metal composites and methods for making such composites wherein the metal has been introduced into a ceramic body in a manner which imparts high fracture toughness and strength to the composite while preserving the ceramic's low density, high hardness and high stiffness. The composites and methods of the present invention also avoid processing difficulties normally resulting from high rates of reaction between the ceramic and the infiltrating metal. In the past, such high rates of reaction have resulted in composites of limited utility due to less than complete infiltration of the ceramic body as well as the formation of unwanted ceramic phases. Both of these factors result in composites that are more susceptible to failure under stress. The invention also overcomes mechanical processing difficulties encountered in mixing and dispersing the ceramic with a reactive metal which heretofore has caused formation of composites that include voids that seriously weaken the product. Although the subsequent description of one illustrative and presently preferred embodiment for carrying out the present invention will be in the context of a boron carbide/aluminum composite, it should be understood that the present invention encompasses other ceramics and metals, examples of which are described below.

Boron carbide/aluminum composites formed in accordance with the present invention comprise a porous body of sintered or unsintered boron carbide infiltrated by aluminum or alloys of aluminum. The porous body of boron carbide includes tapes or layers of boron carbide wherein the layers are defined by unequal densities of boron carbide. Another way of characterizing the layers of boron carbide in the porous body prior to infiltration is by their unequal porosity or "graded" structure, the layers having higher densities of boron carbide being less porous compared to layers having lower densities of boron carbide.

Figure 1:
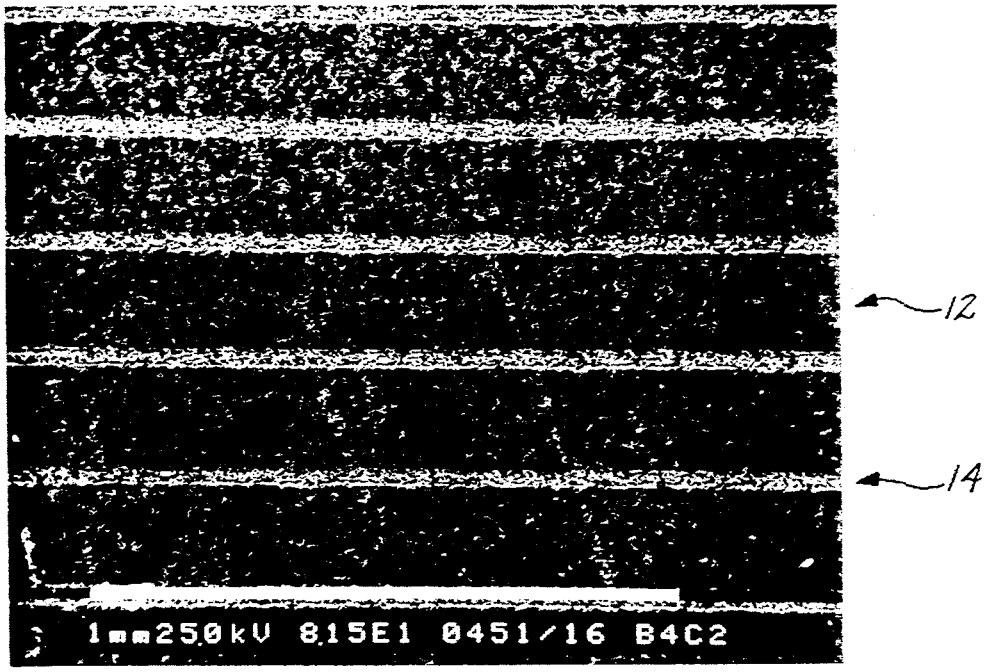
FIG. 1 is a view of a cross section of a sintered porous body of ceramic formed in accordance with the present invention.
Figure 2:
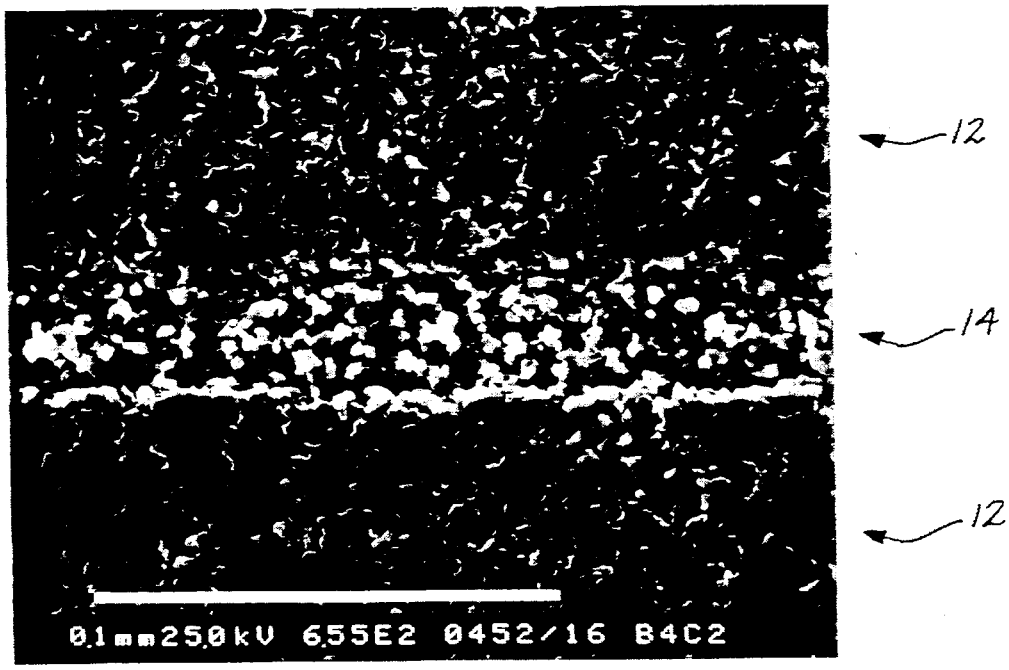
FIG. 2 is an enlarged view of FIG. 1.

Referring to FIGS. 1 and 2, which show a cross section of a sintered porous body of boron carbide formed in accordance with the present invention, layers 12 and 14 are distinguishable by the different degrees of packing of the boron carbide grains. Layer 12 is a dense layer having higher density of boron carbide than layer 14, i.e., less porosity or void fraction than layer 14. Layer 14 is a porous layer having a lower density of boron carbide and higher porosity or void fraction than layer 12. Layers 12 and 14 may be produced by conventional tape casting techniques. The porous body can be produced by pressing the tapes together and removing the binder material as described below. The porous body can then be sintered and infiltrated or directly infiltrated as described below.

Dense layer 12 has sufficient porosity so that the metal can fully infiltrate the porous body. The porosity of the porous layer 14 is generally limited at the upper end by the inability of the layer as cast to retain shape and integrity after casting. If one attempts to make porous layer 14 with an excessive amount of porosity, the layer as cast may not hold its shape after it is cast or after it is dried or sintered.

Figure 3:
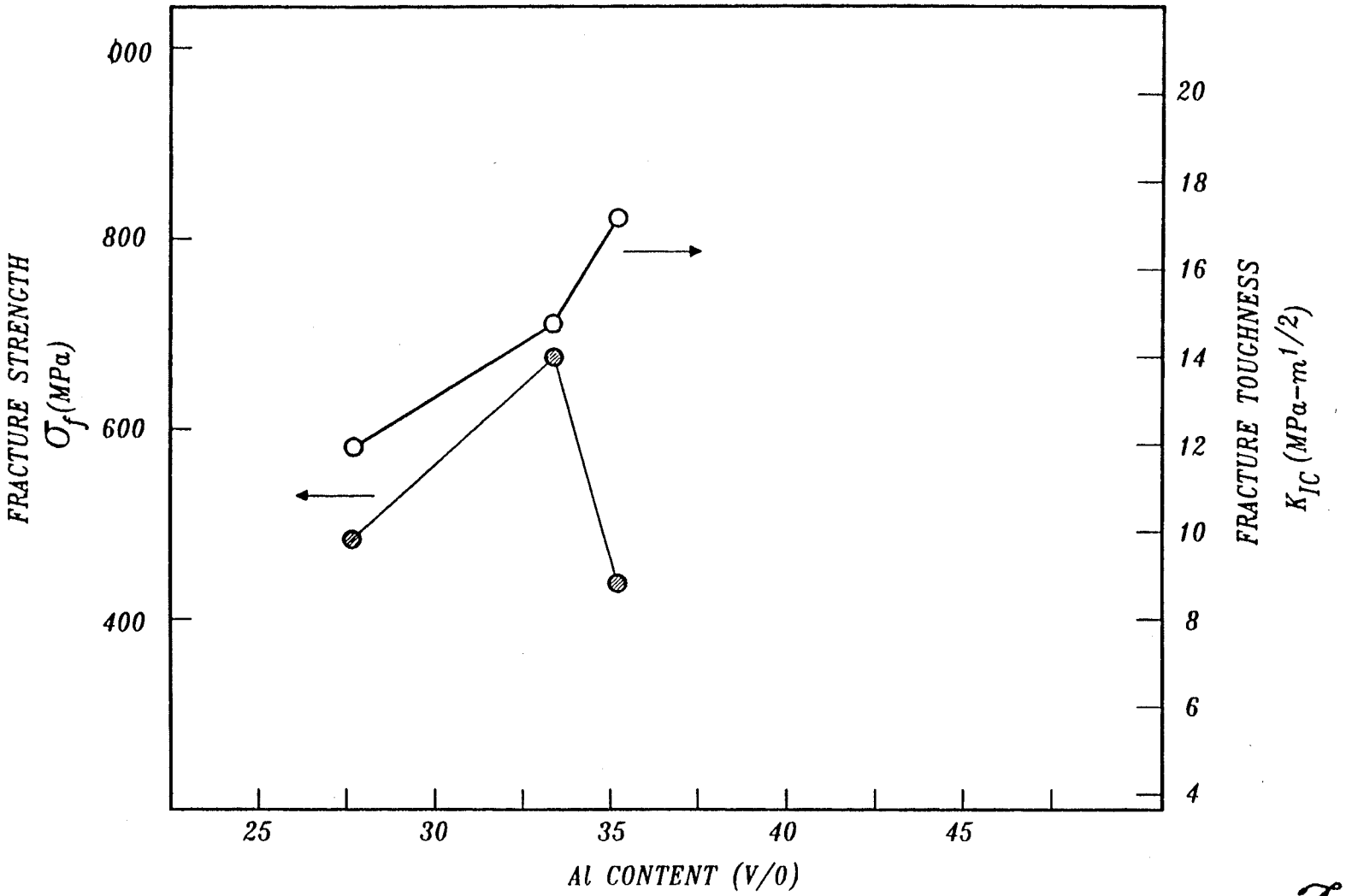
FIG. 3 is a graph of the fracture strength and fracture toughness as a function of metal content for several ceramic/metal composites formed in accordance with the present invention.

For boron carbide/aluminum composites, dense layer 12 preferably has a porosity ranging from about 20 to 35 volume % based on the total volume of the layer. Porous layer 14 preferably has a porosity ranging from about 40 to 60 volume % based on the total volume of porous layer 14. The porosity of the layers dictates the volume % of the boron carbide/aluminum composite that will comprise aluminum. The aluminum content of the composite has an effect on the fracture strength and fracture toughness of the composite. As an example, referring to FIG. 3, a composite that includes a sintered porous body having a dense layers provided from dried tapes about 180 microns thick and porous layers provided from dried tapes about 30 microns thick has a fracture strength that increases as the overall aluminum content of the sintered body increases from about 25 volume % to about 33 volume % based on the total volume of the body. At aluminum contents greater than about 33 volume %, the fracture strength begins to decrease. In contrast, the fracture toughness of the boron carbide/aluminum composite increases continuously over the aluminum content range of about 25 volume % to 35 volume % based on the total volume of the body.

The thickness of the layers 12 and 14 is generally limited on the upper end to thicknesses that do not crack upon drying or that flow when cast. On the low end, the thickness of the layers is generally limited by the processing technique used to make the tape. Within this range, dried layers having thickness on the order of 10 microns to about 600 microns can be used in the present invention. Although tapes as thin as 10 microns can be used, thicker tapes are preferred because they can be more consistently reproduced by conventional tape casting methods.

For boron carbide/aluminum composites, it is a presently preferred practice to use dense layers 12 that are thicker than the porous layers 14 to achieve more complete infiltration of the porous body and obtain composites with a desirable combination of fracture strength and fracture toughness. A presently preferred ratio of thicknesses for the dense and porous layers is about 6:1. Even when the ratio of thickness of the dense and porous layers is 6:1, changing the absolute thickness of the individual layers affects the fracture strength and fracture toughness properties of the composite.

Figure 4:
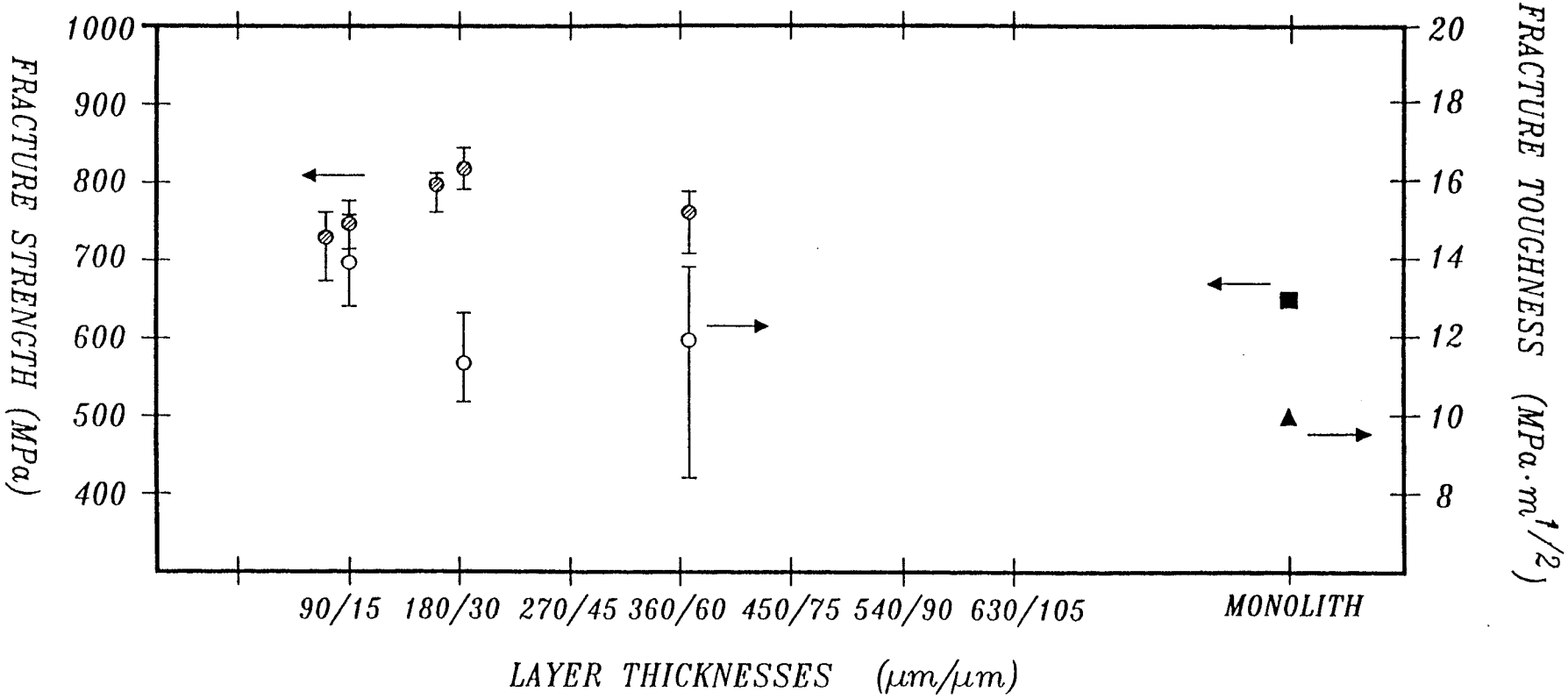
FIG. 4 is a graph of the fracture strength and fracture toughness of a ceramic metal composite wherein the ratio of the thickness of the dense layer to the porous layer is about 6:1.

Referring to FIG. 4, porous bodies including sintered boron carbide particles made from dense and porous boron carbide layers having approximately 32 volume % porosity and 45 volume % porosity, based on the total volume of the respective layers, wherein the ratio of the thickness of the dense layer to the thickness of the porous layer is about 6:1, exhibit fracture toughness ranging from about 8 $MPa \cdot m^{\frac{1}{2}}$–16 $MPa \cdot m^{\frac{1}{2}}$ and fracture strength ranging from about 600 MPa to 850 MPa. Fracture strength was measured using a four-point modulus of rupture test and fracture toughness was evaluated using a three-point straight notch test. As illustrated in FIG. 4, changing the thickness of the individual layers while holding the ratio of thicknesses constant affects both the fracture strength and fracture toughness. For comparison purposes, the fracture strength and fracture toughness for a boron carbide/aluminum composite (34 volume % aluminum) made by infiltrating a monolith of porous boron carbide with aluminum are plotted in FIG. 4. The fracture strength and fracture toughness for the monolith composite are generally lower than the boron carbide/aluminum composites formed in accordance with the present invention.

The grains of boron carbide used in porous layer 14 are preferably grinding powder, having a high content of sub-micron sized particles. Grinding particles, (such as ESK 1500 referred to in the Examples) generally carries a lower surface charge in water compared to the ESK sintering particles referred to in the Examples. In colloidal casting methods, the presence of the sub-micron particles, and resulting lower surface charge, provide a powder which tends to agglomerate more easily and closely compared to the sintering powder particles. Accordingly, the grinding powder is preferred for making porous layer 14. Dense layer 12 is preferably formed using sintering powder particles of boron carbide. The ESK sintering powder particles preferably exhibit a narrow particle size distribution with about 90% of the particles falling in the 1–5 micron range. As discussed above, sintering powder particles tend to carry more surface charge than grinding powder particles. Due to their generally larger size and higher surface charge, the sintering powder particles do not agglomerate as readily or as closely as the grinding particles. Accordingly, sintering powder particles are preferred for the dense layer.

The ceramic component of the ceramic/metal composites formed in accordance with the present invention is chosen so that it is psuedo-compatible with the infiltrating metals described below. A ceramic and a metal are psuedo-compatible if the ceramic and metal bond so that the infiltrated body will exhibit desired physical properties such as fracture strength and toughness. The metal should also wet the ceramic so that complete infiltration of the porous body is readily achieved. The ceramic and metal should also combine to provide reaction kinetics which are slow, relative to the wetting kinetics. This ensures that complete infiltration can be achieved before undesirable reaction products form.

Although aluminum has been described as a suitable metal for infiltrating boron carbide, other examples of metals for infiltrating boron carbide include aluminum alloys, such as Al-Cu, Al-Mg, Al-Si, Al-Mn-Mg, and Al-Cu-Mg-Cr-Zn alloys. Examples of these types of alloys include those designated as Al 2024, Al 7075; Al 5086. Other suitable metals include: Al, As, Ba, Be, Ca, Co, Cr, Fe, Hf, Ir, La, Li, Mg, Mn, Mo, Na, Nb, Ni, Os, Pd, Pt, Pu, Re, Rh, Ru, Sc, Si, Sr, Ta, Tc, Th, Ti, U, V, W, Y, and Zr; and alloys thereof including Ni, Co, and Ti based superalloys, steels and compounds thereof that are reduced to metallic form during processing. These metals are also suitable for infiltrating other ceramics that are psuedo-compatible with the metal as described above. Examples of other suitable ceramics include: $Al_4C_3$, SiC, TiC, VC, CrC, ZrC, NbC, MoC, HfC, TaC, WC, $Al_2O_3$, $B_2O_3$, $BeO_2$, MgO, CaO, $TiO_2$, $V_2O_3$, $Cr_2O_3$, FeO, $Fe_2O_3$, CoO, $Co_2,O_3$, NiO, $Cu_2O$, ZnO, SrO, $Y_2O_3$, $Zr_2O_3$, $Mo_2O_3$, PdO, $SnO_2$, $Hf_2O_3$, $Ta_2O_3$, $3Al_2O_3.2SiO_2$, BN, $Si_3N_4$, AlN, $AlB_2$, $AlB_6$, $AlB_{10}$, $AlB_{12}$, $Al_2SiO_5$, $Mg_2Al_4Si_5O_{18}$, $FeTiO_3$, $Al_2SiO_5$, $Mg_2Al_2O_4$, $CaSiO_3$, $Pb(Zr_{.52}Ti_{.48})O_3$, and $ZrSiO_4$.

Satisfactory bonding of the ceramic and metal can be qualitatively evaluated by determining if a longitudinal load placed on a ceramic/metal bondline between a ceramic bar and metal bar causes the ceramic/metal bond to fail or if the failure occurs in the ceramic or metal alone. If the bondline survives while the ceramic or metal bar fail, the bonding between the ceramic and the metal is satisfactory in the context of the present invention. Satisfactory wetting of the ceramic by the metal is achieved when the wetting angle is low. In order to achieve satisfactory infiltration of a boron carbide porous body, contact angles of 30° or less are suitable. One way of manipulating the contact angle is by varying the temperature at which the infiltration is carried out. Generally, the lower the temperature, the greater the contact angle and the lower the wetting. Increasing the temperature lowers the wetting angle and increases the wetting of the ceramic by the metal. As discussed above, wetting is an important factor in achieving complete infiltration of the porous ceramic body.

Figure 5:
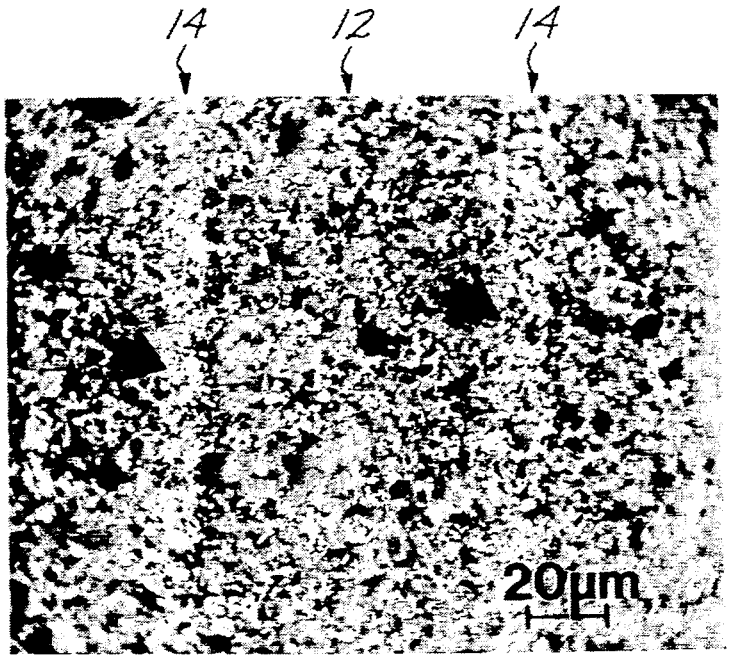
FIG. 5 is an enlarged view of a cross section of a ceramic/metal composite formed in accordance with the present invention.

Referring to FIG. 5, which shows a sintered boron carbide porous body infiltrated with aluminum, complete infiltration is evidenced by complete absence of any voids in the infiltrated body. FIG. 5 shows that aluminum has completely infiltrated both the dense layer 12 and porous layer 14 of the ceramic body. This provides a composite that comprises a continuous matrix of ceramic and a continuous matrix of metal. Applicants believe that the presence of the continuous matrices as opposed to discontinuous matrices of ceramic and metal are one reason the boron carbide/aluminum composites formed in accordance with the present invention exhibit the improved fracture strengths and toughness described below.

Figure 6:
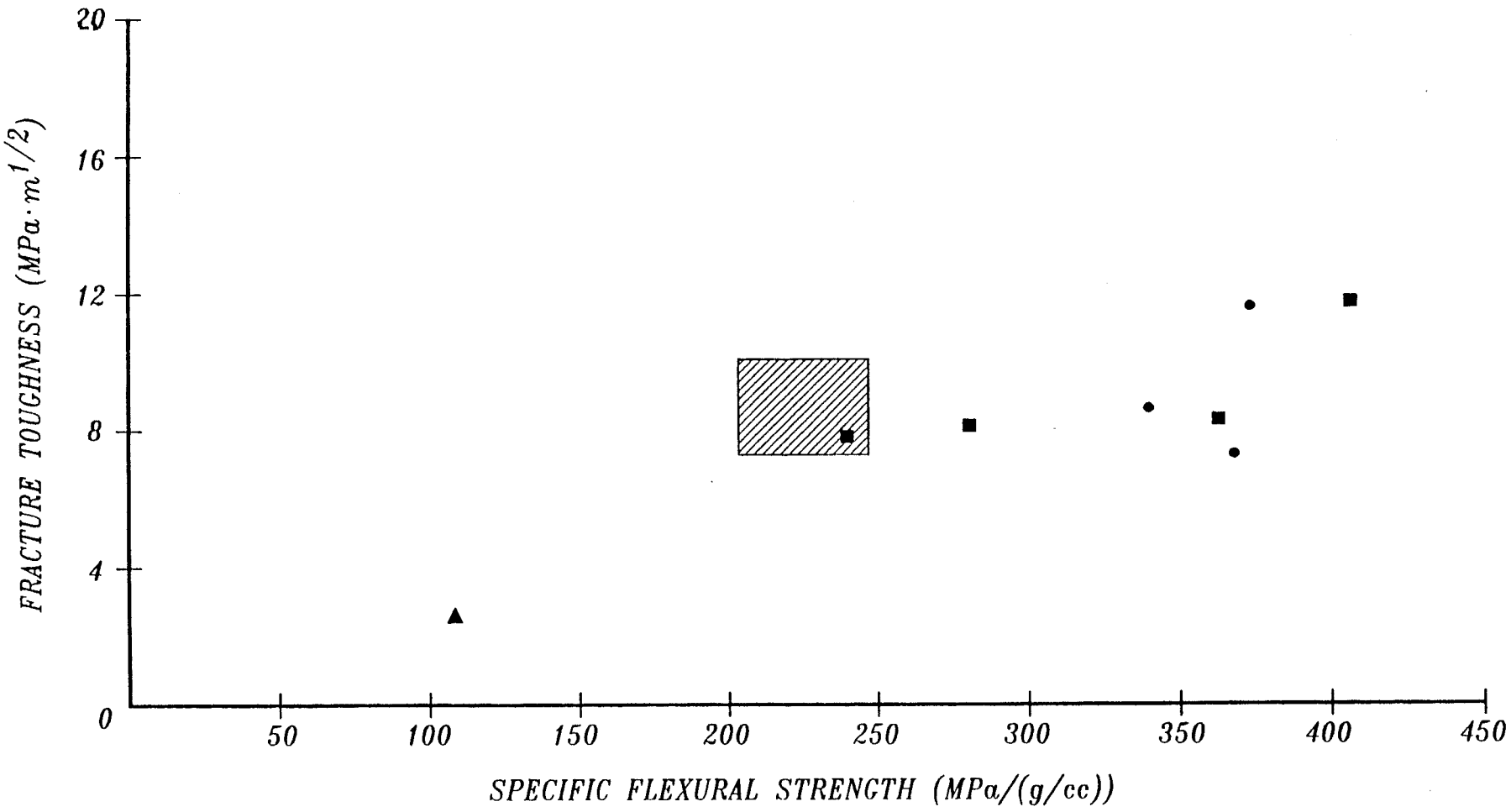
FIG. 6 is a graph showing fracture toughness and specific fracture strength of several ceramic/metal composites formed in accordance with the present invention.

Sintered boron carbide/aluminum alloy composites formed in accordance with the present invention exhibit fracture toughness and fracture strength properties that the inventors are unaware have been exhibited by boron carbide/aluminum composites before. For example, referring to FIG. 6, sintered boron carbide/aluminum alloy composites formed from 75 micron thick dense layers and 12.5 micron thick porous layers having an aluminum alloy content of about 35 volume % exhibit specific fracture strength as high as about 411 MPa/(g/cc) or a fracture strength of about 1030 MPa as measured by a three point modulus of rupture test. The sintered boron carbide/aluminum alloy composites exhibit a fracture toughness ranging between about 7.9 MPa-$m^{\frac{1}{2}}$ to 11.7 MPa-$m^{178}$ as measured by a three point straight notch test. Sintered boron carbide/aluminum composites made from dense layers 75 microns thick and porous layers 12.5 microns thick containing about 35 volume % aluminum formed in accordance with the present invention exhibit specific fracture strength as high as 369.8 MPa/(g/cc) or a fracture strength of about 932 MPa as measured by a three point modulus of rupture test. The sintered boron carbide/aluminum composites exhibit fracture toughness values between about 7.1 and 11.6 MPa-$m^{\frac{1}{2}}$ as measured by a three point straight notch test.

The process for making the sintered and unsintered boron carbide/aluminum and aluminum alloy composites described above is set forth below and in the examples that follow.

Figure 7:
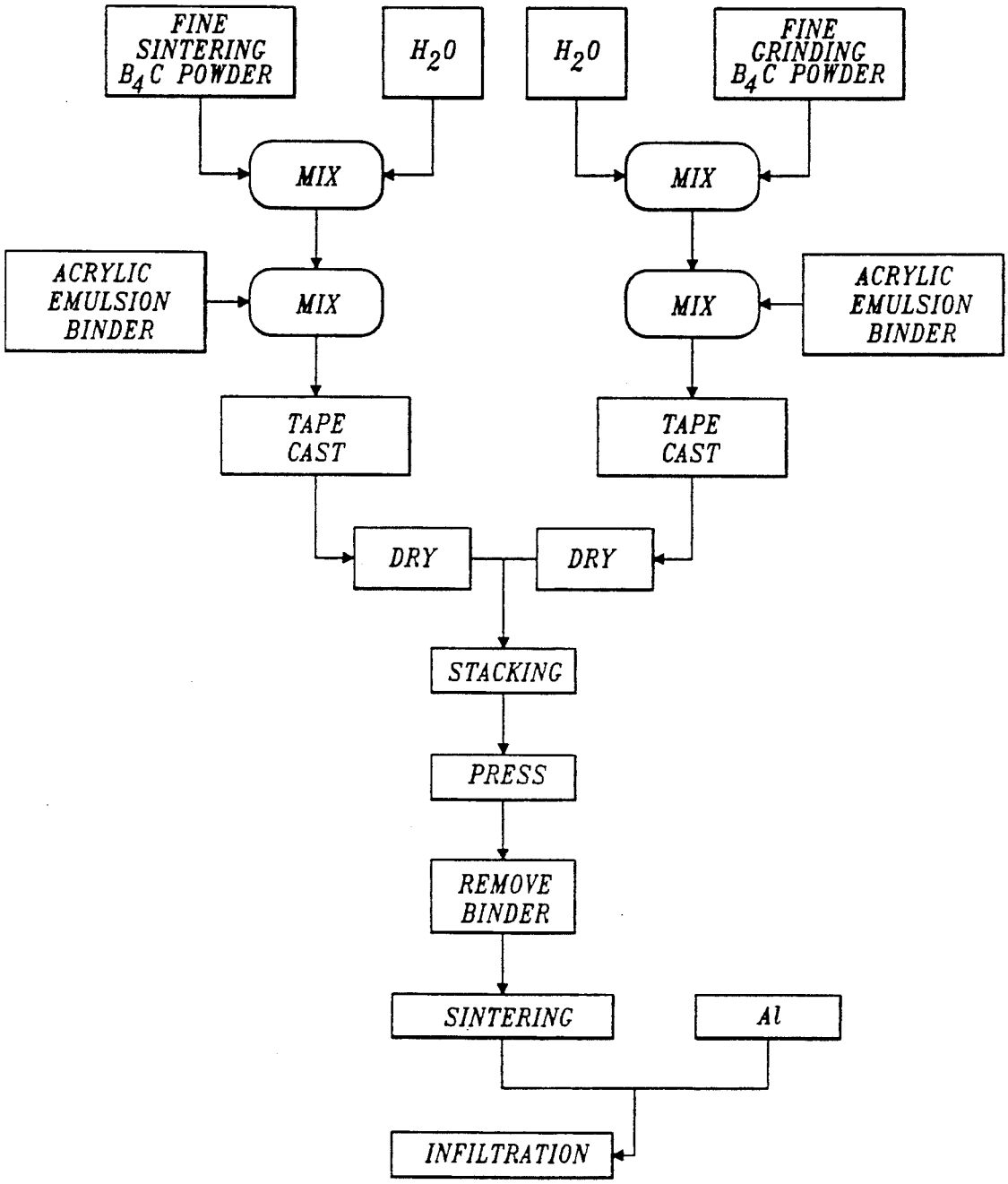
FIG. 7 is a flow chart schematically illustrating the method carried out in accordance with the present invention.

Referring to FIG. 7, the method of the present invention for making boron carbide/aluminum composites wherein the ceramic material has been sintered, includes the steps of forming a suspension of boron carbide in solvent, adding binder to the suspension, casting tapes from the suspension, drying the tapes, stacking the tapes, pressing the tapes together, and removing the binder to provide a porous boron carbide body. The porous boron carbide body is then sintered followed by an infiltration step to introduce the aluminum into the porous body. The method for making boron carbide/aluminum composites wherein the ceramic material is not sintered is similar to the method for making a sintered composite, but does not include the sintering step prior to infiltration.

Referring to the specific steps described above for making sintered composites, forming a suspension of boron carbide in water, adding a binder and casting the tapes can be accomplished using conventional techniques. For example, U.S. Pat. No. 4,77,153 to Sonuparlak and Aksay describes how a suspension of ceramic particles can be formed into flexible tapes using tape casting techniques.

A suspension of boron carbide particles in a solvent, such as deionized water, may be achieved using ultrasonic dispersion. In order to remove air that is introduced during the dispersing step, dearification of the suspension should be carried out.

The porosity of the porous body can be controlled by the choice of particles used to form the suspension. As described above, sintering powder particles of boron carbide form a more dense, i.e., less porous tape when consolidated. For less dense or more porous tapes, grinding boron carbide powders can be used. The porosity of the dense and porous layers can also be manipulated by relying upon conventional electrostatic, steric, or combined electrostatic and steric (electrosteric) means of controlling the suspension. Using these means, it is possible to control the forces between the particles causing them to remain dispersed or allowing them to flocculate. In addition to the choice of the type of particles used, manipulating the pH of the suspension is a presently preferred way of controlling the porosity of the porous tapes. As a general trend, increasing the pH has the effect of decreasing the porosity of the dense and porous layers.

Tape casting typically requires that the suspension to be cast have a solids content ranging from about 10–55 volume %, based on the total volume of the suspension. Tapes formed in accordance with the present invention can be cast from suspensions that have a concentration of boron carbide ranging from about 20 to 40 volume % based on the volume of the suspension. Suspensions having these concentrations can provide sintered tapes having boron carbide densities ranging from about 55 to 80 volume % based on the volume of the tape.

After the suspension is formed, e.g., an acrylic polymer binder such as Rhoplex TM HA-8, HA-12, and/or HA-16 available from Rohm and Haas Co., is added. In order to provide dried dense tapes, the binder HA-8 is preferably used in an amount ranging from about 5.0 to 6.0 weight % based on the weight of boron carbide in suspension. For porous tapes, the binders HA-12 and HA-16 are preferably used in an amount of about 10 to 12 weight % each, based on the total weight of the boron carbide in suspension. When adding the binder, care should be taken that bubbles are not introduced into the suspension with the mixing. The mixing preferably is carried out under conditions that avoid or minimize the introduction of bubbles into the solution. Bubbles in the solution are undesirable, as they can lead to voids in the cast tapes and ultimately in the sintered body. Mixing of the binder into the boron carbide and water should be continued until the binder is uniformly dispersed among the boron carbide particles.

The suspension of boron carbide particles and binder can then be cast into a tape using conventional tape casting methods. The tapes can be cast onto any surface from which they can be readily removed. For boron carbide, a film of oriented polypropylene is suitable. The rate of casting should be such that shear thinning is induced during casting.

After the tapes are cast they are allowed to dry to remove the solvent. Drying can be accomplished at room temperature or temperatures up to about 60° C. No special drying environment is needed. When the tapes are cast to provide dried tapes that are about 30 to 400 microns thick, drying times on the order of about 24 hours are appropriate. During drying, the binder tends to concentrate near the lower surface of the tape which is adjacent the film upon which it is cast. Accordingly, the upper surface of the tape which is opposite the supporting film has a lower concentration of binder.

Next, the dried tapes are cut to suitable lengths and stacked. In order to achieve complete infiltration, it is preferred that the tapes be arranged in an alternating pattern of dense and porous tapes. The tapes are consistently stacked such that the lower surface of one tape rests against the upper surface of the adjacent tape. By stacking the tapes in this consistent pattern, the adhesion between adjacent layers is improved because interfaces of low binder content are avoided. The maximum combined thickness of the stacked porous tapes will be limited by the ability to completely infiltrate the sintered porous body. Sintered porous bodies as thick as ½ inch have been completely infiltrated in accordance with the present invention.

After the tapes have been stacked, they are pressed together which causes the tapes to adhere to each other. The stack of tapes are pressed together by slowly placing them under a load of about 5000 psi. The size of the load and the rate of applying the load is controlled to avoid cracking of the tapes. Thinning of the tapes should also be avoided, although a slight amount of thinning is unavoidable. When the applied load is approximately 5000 psi, a loading time of 30 minutes, combined with a holding time of about 5–10 minutes and an unloading time of about 30 minutes has been found to provide satisfactory adhesion between the adjacent tapes of boron carbide, without excessive thinning. When the load is removed, it should be removed slowly so that "springback" is avoided or at least minimized. As discussed above, since the tapes are compressed slightly under the load, "springback" results from the natural tendency of the tapes to return to their original dimension. Springback should be avoided because it tends to cause cracks in the pressed body as well as delamination between adjacent tape layers.

After the tapes have been pressed together to form an integral body, the binder material is removed in order to provide a porous boron carbide body. The acrylic binder can be removed by heating the pressed tapes in air to about 320° C. and holding it at this temperature for approximately 10 to 24 hours. When using boron carbide, the temperature should not exceed 320° C. because boron carbide oxidizes at temperatures above 320° C. in air. The time needed to remove the binder will depend on the size of the body. The binder that is not removed in this step will be removed in the subsequent heating steps. Depending on the desired composite, these subsequent heating steps can be carried out to achieve removal of the remaining binder material and sintering of the ceramic material or just removal of the remaining binder material.

To provide boron carbide composites wherein the boron carbide has not been sintered, the binder material can be removed by subsequent heating steps carried out at temperatures up to about 700° C. in an environment that inhibits oxidation of the boron carbide. Argon and helium environments are suitable. Holding boron carbide bodies at these temperatures for approximately 2 to 4 hours completes the removal of the binder material and provides an unsintered porous body of boron carbide.

Solid state diffusion within the porous body of boron carbide is achieved by sintering. After the binder material is removed, the boron carbide bodies can be sintered at temperatures of about 1900° C. to 2200° C. and times of about 1 to 30 minutes. Higher temperatures or longer times lead to an decreased porosity in the sintered body and vice-versa. To avoid oxidation of the boron carbide the sintering should be carried out in argon or helium. The sintering temperatures above 1900° C. are preferred because bodies of boron carbide sintered above 1900° C. exhibit a lower reactivity with aluminum compared to bodies that are sintered below 1900° C. Minimizing the reactivity of boron carbide and aluminum is desired to avoid the production of reaction products and ceramic phases that hinder complete infiltration and the overall composite properties. Satisfactory sintering in the context of the present invention is achieved when macroscopic defects such as cracks, voids and delaminations in the porous body are absent.

Infiltration is used to introduce the aluminum into the sintered or unsintered boron carbide porous body. Infiltration is achieved by immersing the porous body in a bath of molten aluminum or by placing a solid aluminum ingot on the porous body and heating it to approximately 1200° C. under a vacuum of approximately $10^{-5}$ torr. At this temperature, the contact angle is generally less than 30° so aluminum wets and completely infiltrates the boron carbide porous body. For infiltration, an argon environment can be used; however, such an environment is less effective because it tends to require a higher temperature in order for the wetting angle to be lower than 30°. This increased temperature increases the reactivity of the boron carbide and aluminum which results in the production of undesirable ceramic phases which tend to hinder complete infiltration of the porous body. The time required for complete infiltration of the porous body generally depends upon the thickness of the porous body. Bodies up to ½ inch thick have been successfully infiltrated by contacting them with the aluminum for time periods on the order of about 30 minutes. After the infiltration step the composite is allowed to cool to room temperature.

The boron carbide/aluminum composites described above provide low density and high strength materials that can be used in a number of applications. The composites are made by a process which allows the particular amounts of boron carbide and aluminum to be accurately controlled which allows the physical properties of the composite to be easily manipulated.

The following examples are intended to illustrate the present invention and are not intended to be limitations thereof.

EXAMPLE 1

$B_4C$/aluminum composites

A suspension with 25 volume % $B_4C$ particles based on the volume of water is formed by adding ESK 1500 grinding boron carbide powder (manufactured by Elektroschemeltzwerk Kempten, Munich, Germany) to deionized water. The suspension is formed by slowly adding the boron carbide powder to the water in a beaker as it is being stirred on a stir plate by a Teflon stir bar. The stirring is vigorous enough to create a vortex. The powder is added slowly to minimize addition of air to the suspension.

The suspension is ultrasonicated using a 200 watt sonic cell dismembrator with a one-half inch probe at 35% power. The suspension is ultrasonicated while stirring for 20 minutes. The time limit of ultrasonication is set so that the addition of energy to the suspension is insufficient to heat the suspension to the point of flocculation.

The suspension is deaired in a vacuum desiccator while stirring in a vacuum of minus 25–30 inches of mercury. This vacuum removes air bubbles caused by the addition of powder and ultrasonication, but is insufficient to boil the suspension. Deairification is completed in approximately 20 minutes.

The pH of the suspension is adjusted to about 3 by adding hydrochloric acid. Two latex emulsion high glass transition temperature binders available from Rohm and Haas Co. under the name Rhoplex TM HA-12 and HA-16 are added in the amount of 11 weight % each based on the weight of boron carbide in suspension. The complete suspension is stirred without a vortex for a period of not less than one hour or more than four hours. The suspension is covered with paraffin. The suspension is allowed to age, ensuring the complete mixing of the latex particles amidst the boron carbide powder. After aging, the stir bar is removed from the suspension.

The suspension is then tape cast onto an untreated oriented polypropylene tape. The suspension is cast on an untouched interior surface of the polypropylene tape. Casting is done in a relatively dust-free environment. The polypropylene tape is placed on glass sheets approximately four feet long with the casting face up. An adjustable doctor blade is used to cast the boron carbide suspension on the polypropylene tape. A casting rate of 0.05 meters per second is used in order to induce shear thinning while casting. The doctor blade is set at approximately three times the desired thickness of the tape. A setting of 100 micrometers is used to cast tapes about 30 micrometers thick. After casting, the tapes are partially covered to prevent dust accumulation and to extend the drying time. The tapes are used to provide sintered layers that have a $B_4C$ density of about 55 volume % based on the total volume of the layer.

A suspension of 28 volume % of boron carbide ESK 5 micrometer sintering powder (manufactured by Elektroschemeltzwerk Kempten, Munich, Germany), based on the volume of deionized water is formed as described above. The pH of the suspension is adjusted to 5 by the addition of ammonium hydroxide. The latex emulsion binder added is a low glass transition temperature binder available from Rohm & Haas under the name Rhoplex TM HA-8. The binder is added to the suspension in an amount of 5.5 weight % based on the weight of boron carbide in suspension. The suspension is then stirred and allowed to age before it is cast as described above.

The doctor blade is set at 560 micrometers which provides thick tapes having a thickness of about 180 micrometers. As before, after casting, the tapes are partially covered to prevent dust accumulation and to extend the drying time. These tapes are used to provide sintered layers that have a $B_4C$ density of about 68 volume % based on the total volume of the layers.

Both the thick and thin tapes are allowed to dry for 24 hours. Thereafter, the tapes are punched out by placing the boron carbide/latex and polypropylene tape assembly on a rubber pad and using a razor blade punch-ejector assembly. After ejection from the punch, dust and particles are carefully removed from both surfaces and edges of the tapes using a soft camel hair artist's brush. The boron carbide/latex tapes are not touched by hand.

Next, the individual tapes are stacked with their shiny surface up (the surface that was in contact with the polypropylene tape) in an alternating pattern of thick and thin layers. The base on which they are stacked is a flat, horizontal steel plate covered with a layer of wax or laboratory weighing paper. The tapes are stacked to the desired thickness of about one-quarter of an inch, and then covered with wax paper and another flat steel plate parallel to the first steel plate.

The steel plate, wax paper, boron carbide, wax paper, steel plate assembly is then placed in a press whose top and bottom platens have been carefully aligned to parallel. Pressing is done at a pressure of 5000 psi, taking one-half hour to reach 5000 psi. The 5000 psi load is maintained for 10 minutes after which, it is released slowly over the period of one-half hour.

The pressed stack is then loaded into a graphite crucible normally used for high temperature sintering. The crucible is placed in a low temperature ashing furnace and heated in air at a rate of 0.2° C. per minute to 320° C. and held for an extended period of time in order to partially burn out and convert the latex. In this example, the pressed stack was held at 320° C. for 24 hours.

The crucible is carefully removed from the ashing furnace and placed in a high temperature graphite furnace. The graphite furnace is evacuated to 10 millitorr then backfilled with argon to one atmosphere. The vent of the furnace is open and a flow through of argon and helium at 3.0 and 0.3 standard cubic feet per hour, respectively, established. The furnace is slowly heated at a rate of 5° C. per minute up to 500° C. and held for two hours. It is then heated up to 700° C. for two hours to complete binder removal and conversion. The boron carbide structure is then heated at 5° C. per minute to 2000° C. and held for three minutes to sinter. Thereafter, the furnace is allowed to cool down naturally. The sintered body has an overall porosity of approximately 33 to 34 volume % based on the total volume of the body.

The sintered porous body is then infiltrated by removing the graded boron carbide body from the graphite crucible and placing it into an aluminum oxide crucible surrounded by more than sufficient aluminum to fill the open porosity of the body. The alumina crucible with the aluminum and boron carbide body is placed in a refractory metal high vacuum furnace, evacuated for at least two hours, and heated under conditions of high vacuum ($10^{-5}$ torr range) for two hours to 1200° C. The time held at 1200° C. depends on the thickness of the sample, with from 5 minutes for one millimeter to 30 minutes for one centimeter being found satisfactory. The infiltrated body is then allowed to cool to room temperature. The alumina crucible is then removed by a lapidary saw with care not to stress the infiltrated body.

The infiltrated body is then subjected to a four-point modulus of rupture test to test its fracture strength and a three-point straight notch test (ASTM-399-83) to evaluate its fracture toughness. The results are summarized in Table 1 and illustrated graphically in FIG. 3 along with values for composites having an aluminum content of about 27 and 35 volume %.

TABLE 1

| Al Content (V/O) | Fracture Strength Modulus of Rupture MPa (4-Pt) | Fracture Toughness MPa-m½ |
|---|---|---|
| 27 | 482 | 12.0 |
| 33 | 677 | 14.8 |
| 35 | 438 | 17.2 |

The procedure described above was used to produce multiple samples of aluminum infiltrated sintered boron carbide bodies having layer thicknesses of 90/15, 180/30, and 360/60. Each of these composites was tested for fracture strength and fracture toughness. The results are illustrated graphically in FIG. 4 and the maximum values summarized in Table 2. The composites having dense layers about 180 micrometers and porous layers about 30 micrometers thick exhibit fracture strength values greater than the other composites of this example. Composites having a dense layer 90 micrometers thick and a porous layer 15 micrometers thick exhibit fracture toughness values that are higher than the other composites of this example. For comparison purposes fracture strength and fracture toughness values for a boron carbide/aluminum composite made from a monolith of boron carbide are listed.

TABLE 2

| | Maximum Values | |
|---|---|---|
| Layer Ratio | Fracture Strength (4-Pt) MPa | Fracture Toughness MPa-m½ |
| 90/15 | 788 | 15.8 |
| 180/30 | 842 | 12.6 |
| 360/60 | 785 | 13.7 |
| Monolithic | 662 | 10.1 |

EXAMPLE 2

$B_4C$/Aluminum Composite

Example 1 was reproduced, with the exception that the dense layer was 75 microns thick and the porous layer was 12.5 microns thick. Multiple samples were tested in accordance with Example 1 and the results are summarized in the Table 3 and graphically represented as filled in circles in FIG. 6. For comparison purposes, the fracture strength and fracture toughness of boron carbide is plotted in FIG. 6 as a filled in triangle. Also for comparison purposes, representative fracture toughness and fracture strength values for boron carbide/aluminum composites formed from monoliths of boron carbide are plotted on FIG. 6 as a cross-hatched rectangle.

EXAMPLE 3

$B_4C$/Aluminum Alloy 2024 Composite

Example 1 was reproduced, with the exception that an aluminum alloy designated 2024 was used to infiltrate the porous $B_4C$ body and the dense layer was 75 microns thick and the porous layer was 12.5 microns thick. Multiple samples were tested in accordance with Example 1 and the results are summarized in the Table 3 and graphically represented as filled in squares in FIG. 6. Fracture toughness values were not obtained for Sample Nos. 8 and 9.

TABLE 3

| SAMPLE | INFILTRANT | SPECIFIC FRACTURE STRENGTH MPa/(g/cc) | THREE-POINT FRACTURE STRENGTH MPa | FRACTURE TOUGHNESS MPa-m½ |
|---|---|---|---|---|
| 1 | Al | 339.7 | 856 | 8.7 |
| 2 | Al | 373.4 | 941 | 11.6 |
| 3 | Al | 369.8 | 932 | 7.2 |
| 4 | 2024 Al alloy | 238.5 | 601 | 7.9 |
| 5 | 2024 Al alloy | 406 | 1023 | 11.7 |
| 6 | 2024 Al alloy | 357 | 900 | 8.2 |
| 7 | 2024 Al alloy | 282.5 | 712 | 8.1 |
| 8 | 2024 Al alloy | 411.9 | 1038 | — |
| 9 | 2024 Al alloy | 216.3 | 545 | — |

Examples 1-3 show that $B_4C$/aluminum composites including sintered porous bodies can be made with fracture strengths as high as 856 MPa and fracture toughness values as high as 11.6 MPa-M½ and $B_4C$/aluminum alloy composites can be produced which exhibit fracture strengths as high as 1038 MPa and fracture toughness values as high as 11.7 MPa-M½.

EXAMPLE 4

Unsintered $B_4C$/aluminum composites

A boron carbide/aluminum composite formed in accordance with the present invention using an unsintered porous body of boron carbide is made according to this example.

A suspension of 25 volume % $B_4C$ particles based on the volume of water is formed by adding ESK 1500 grinding boron carbide powder (manufactured by Elektroschemeltzwerk Kempten, Munich, Germany) to deionized water. The suspension is formed by slowly adding the boron carbide powder to the water in a beaker as it is being stirred on a stir plate by a Teflon stir bar. The stirring is vigorous enough to create a vortex. The powder is added slowly to minimize addition of air to the suspension.

The suspension is ultrasonicated using a 200 watt sonic cell dismembrator with a one-half inch probe at 35% power. The suspension is ultrasonicated while stirring for 20 minutes. The time limit of ultrasonication is set so that the addition of energy to the suspension is insufficient to heat the suspension to the point of flocculation.

The suspension is deaired in a vacuum desiccator while stirring in a vacuum of minus 25-30 inches of mercury. This vacuum removes air bubbles caused by the addition of powder and ultrasonication, but is insufficient to boil the suspension. Deairification is completed in approximately 20 minutes.

The pH of the suspension is adjusted to about 3 by adding hydrochloric acid. Two latex emulsion high glass transition temperature binders available from Rohm and Haas Co. under the name Rhoplex TM HA-12 and HA-16 are added in the amount of 11 weight % each based on the weight of boron carbide in suspension. The complete suspension is stirred without a vortex for a period of not less than one hour or more than four hours. The suspension is covered with paraffin. The suspension is allowed to age, ensuring the complete mixing of the latex particles amidst the boron carbide powder. After aging, the stir bar is removed from the suspension.

The suspension is then tape cast onto an untreated oriented polypropylene tape. The suspension is cast on an untouched interior surface of the polypropylene tape. Casting is done in a relatively dust-free environment. The polypropylene tape is placed on glass sheets approximately four feet long with the casting face up. An adjustable doctor blade is used to cast the boron carbide suspension on the polypropylene tape. A casting rate of 0.05 meters per second is used in order to induce shear thinning while casting. The doctor blade is set at approximately three times the desired thickness of the tape. A setting of 100 micrometers is used to cast tapes about 30 micrometers thick. After casting, the tapes are partially covered to prevent dust accumulation and to extend the drying time. The tapes are used to provide layers that have a $B_4C$ density of about 55 volume % based on the total volume of the layer.

A suspension of 28 volume % boron carbide ESK 5 micrometer sintering powder (manufactured by Elektroschemeltzwerk Kempten, Munich, Germany), based on the volume of deionized water is formed as described above. The pH of the suspension is adjusted to 5 by the addition of ammonium hydroxide. The latex emulsion binder added is a low glass transition temperature binder available from Rohm & Haas under the name Rhoplex TM HA-8. The binder is added to the suspension in an amount of 5.5 weight % based on the weight of boron carbide in suspension. The suspension is then stirred and allowed to age before it is cast as described above.

The doctor blade is set at 560 micrometers which provides thick tapes having a thickness of about 180 micrometers. As before, after casting, the tapes are partially covered to prevent dust accumulation and to extend the drying time. These tapes are used to provide layers that have a $B_4C$ density of about 68 volume % based on the total volume of the layers.

Both the thick and thin tapes are allowed to dry for 24 hours. Thereafter, the tapes are punched out by placing the boron carbide/latex and polypropylene tape assembly on a rubber pad and using a razor blade punch-ejector assembly. After ejection from the punch, dust and particles are carefully removed from both surfaces and edges of the tapes using a soft camel hair artist's brush. The boron carbide/latex tapes are not touched by hand.

Next, the individual tapes are stacked with their shiny surface up (the surface that was in contact with the polypropylene tape) in an alternating pattern of thick and thin layers. The base on which they are stacked is a flat, horizontal steel plate covered with a layer of wax or laboratory weighing paper. The tapes are stacked to the desired thickness of approximately one-quarter of an inch, and then covered with wax paper and another flat steel plate parallel to the first steel plate.

The steel plate, wax paper, boron carbide, wax paper, steel plate assembly is then placed in a press whose top and bottom platens have been carefully aligned to parallel. Pressing is done at a pressure of 5000 psi, taking one-half hour to reach 5000 psi. The 5000 psi load is maintained for 10 minutes after which, it is released slowly over the period of one-half hour.

The pressed stack is then loaded into a graphite crucible normally used for high temperature sintering. The crucible is placed in a low temperature ashing furnace and heated in air at a rate of 0.2° C. per minute to 320° C. and held for an extended period of time in order to partially burn out and convert the latex. In this example, the pressed stack was held at 320° C. for 24 hours.

The crucible is carefully removed from the ashing furnace and placed in a high temperature graphite furnace. The graphite furnace is evacuated to 10 millitorr then backfilled with argon to one atmosphere. The vent of the furnace is open and a flow through of argon and helium at 3.0 and 0.3 standard cubic feet per hour, respectively, established. The furnace is slowly heated at a rate of 5° C. per minute up to 500° C. and held for two hours. It is then heated up to 700° C. for two hours to complete binder removal and conversion. thereafter, the furnace is allowed to cool down naturally. The resultant unsintered porous body has an overall porosity of approximately 33 to 34 volume % based on the total volume of the body.

The unsintered porous body is then infiltrated by removing the graded boron carbide body from the graphite crucible and placing it into an aluminum oxide crucible surrounded by more than sufficient aluminum to fill the open porosity of the body. The alumina crucible with the aluminum and boron carbide body is placed in a refractory metal high vacuum furnace, evacuated for at least two hours, and heated under conditions of high vacuum ($10^{-5}$ torr range) for two hours to 1200° C. The time held at 1200° C. depends on the thickness of the sample, with from 5 minutes for one millimeter to 30 minutes for one centimeter being satisfactory. The infiltrated body is then allowed to cool to room temperature. The alumina crucible is then removed by a lapidary saw with care not to stress the infiltrated body.

The resulting composite of unsintered boron carbide and aluminum includes boron carbide grains that are not as connected as the boron carbide grains in a composite made from a porous body of sintered boron carbide. Accordingly, the unsintered composite exhibits fracture toughness greater than its sintered counterpart, but fracture strength lower than its sintered counterpart.

While the preferred embodiment of the invention has been illustrated and described, it will be appreciated that various changes can be made therein without departing from the spirit and scope of the invention. The embodiments of the invention in which an exclusive property or privilege is claimed are defined as follows:

We claim:

1. A method of making a composite of a ceramic and a metal, the method comprising the steps of:

forming a first set of unsintered layers from a suspension of ceramic particles;

forming a second set of unsintered layers from a suspension of ceramic particles, the volume percent of the ceramic particles in the first set of layers being unequal to the volume percent of the ceramic particles in the second set of layers;

stacking the unsintered layers to form a body;

converting the body to a porous body having layers with different pore volumes; and infiltrating the porous body with the metal.

2. The method of claim 1 wherein the step of stacking the unsintered layers into a body, further comprises stacking and pressing the unsintered layers together.

3. The method of claim 1 wherein the unsintered layers include a binder material, the method between the step of stacking the unsintered layers to form a body and the infiltrating step further comprising a step of removing the binder material from the body.

4. The method of claim 3, wherein the removing step comprises heating the binder material to a temperature sufficient to remove it from the body.

5. The method of claim 4, wherein the temperature of the removing step is insufficient to oxidize the ceramic particles.

6. The method of claim 1, wherein the infiltrating step further comprises immersing the porous body in a liquid bath of the metal.

7. The method of claim 1, wherein the ceramic particles are boron carbide and the metal is aluminum.

8. The method of claim 1, wherein the unsintered layers are tapes.

9. The method of claim 1, wherein a first set of the layers with different pore volumes has a porosity ranging from about 20–30 volume percent based on the total volume of the first set of the layers with different pore volumes and a second set of the layers with different pore volumes has a porosity ranging from about 40–60 volume percent based on the total volume of the second set of layers with different pore volumes.

10. The method of claim 1, wherein the unsintered layers of the first set and the second set are arranged in a repetitive pattern.

11. The method of claim 10, wherein the repetitive pattern is of alternating unsintered layers from the first set and the second set.

12. A method of making a composite of a ceramic and a metal, the method comprising the steps of:

forming a first set of unsintered layers from a suspension of ceramic particles;

forming a second set of unsintered layers from a suspension of ceramic particles, the volume percent of the ceramic particles in the first set of layers being unequal to the volume percent of the ceramic particles in the second set of layers;

stacking and pressing the unsintered layers to form a body, the unsintered layers of the first set and the unsintered layers of the second set arranged in a repetitive pattern;

converting the body to a porous body; and infiltrating the porous body with the metal.

13. The method of claim 12, wherein the repetitive pattern is of alternating unsintered layers from the first set and the second set.

14. A method of making a composite of a ceramic and a metal, the method comprising the steps of:

forming a first set of unsintered layers from a suspension of ceramic particles;

forming a second set of unsintered layers from a suspension of ceramic particles, the volume percent of the ceramic particles in the first set of layers being unequal to the volume percent of the ceramic particles in the second set of layers;

stacking the unsintered layers to form a body;

sintering the body to provide a porous ceramic body having layers with different pore volumes; and infiltrating the porous ceramic body with the metal.

15. The method of claim 14, wherein the step of forming the unsintered layers into a body, further comprising stacking and pressing the unsintered layers together.

16. The method of claim 15, wherein the unsintered layers of the first set and the second set are arranged in a repetitive pattern.

17. The method of claim 16, wherein the repetitive pattern is of alternating unsintered layers from the first set and the second set.

18. The method of claim 14, wherein the unsintered layers include a binder material, the method between the step of stacking the unsintered layers to form a body and the sintering step further comprising a step of removing the binder material from the body.

19. The method of claim 18, wherein the removing step comprises heating the binder material to a temperature sufficient to remove it from the body.

20. The method of claim 19, wherein the temperature of the removing step is insufficient to oxidize the ceramic particles.

21. The method of claim 14, wherein the infiltrating step further comprises immersing the sintered body in a liquid bath of the metal.

22. The method of claim 14, wherein the ceramic particles are boron carbide and the metal is aluminum.

23. The method of claim 14, wherein the unsintered layers are tapes.

24. The method of claim 14, wherein a first set of the layers with different pore volumes has a porosity ranging from about 20–35 volume percent based on the total volume of the first set of the layers with different pore volumes and a second set of the layers with different pore volumes has a porosity ranging from about 40–60 volume percent based on the total volume of the second set of the layers with different pore volumes.

* * * * *

UNITED STATES PATENT AND TRADEMARK OFFICE

CERTIFICATE OF CORRECTION

PATENT NO. : 5,308,422

DATED : May 3, 1994

INVENTOR(S) : I.A. Askay et al.

It is certified that error appears in the above-indentified patent and that said Letters Patent is hereby corrected as shown below:

| COLUMN | LINE | |
|---|---|---|
| 4 | 26 | "thickness" should read --thicknesses-- |
| 6 | 24 | after "carbide/aluminum" insert --or aluminum-- |
| 6 | 38 | "MPa-m$^{178}$" should read --MPa-m$^{1/2}$-- |
| 7 | 5 | "No. 4,77,153" should read --4,777,153-- |
| 15 | 10 | "thereafter" should read --Thereafter-- |

Signed and Sealed this

Thirteenth Day of September, 1994

*Attest:*

*Attesting Officer*

Bruce Lehman

BRUCE LEHMAN

*Commissioner of Patents and Trademarks*